US006110231A

United States Patent [19]

Cooke

[11] Patent Number: 6,110,231

[45] Date of Patent: Aug. 29, 2000

[54] METHOD OF PROCESSING TEXTILE PRODUCTS UTILIZING DECOMPOSABLE EMULSIFIERS

[75] Inventor: Thomas W. Cooke, Greensboro, N.C.

[73] Assignee: Boehme Filatex, Inc., Reidsville, N.C.

[21] Appl. No.: 09/088,254

[22] Filed: Jun. 1, 1998

[51] Int. Cl.[7] ..... D06M 13/137; D06P 5/00

[52] U.S. Cl. ..... 8/495; 8/115.6; 427/443

[58] Field of Search ..... 8/495, 580, 115.6, 8/907; 427/322, 434.6, 443; 252/8.63, 8.81

[56] References Cited

U.S. PATENT DOCUMENTS

| | | | |
|---|---|---|---|
| 3,875,197 | 4/1975 | Lorenz | 8/127.6 |
| 5,389,136 | 2/1995 | Danner | 8/115.6 |
| 5,837,371 | 11/1998 | Rivas | 8/495 |

FOREIGN PATENT DOCUMENTS

| | | |
|---|---|---|
| 0 742 177 A1 | 11/1996 | European Pat. Off. . |
| 0 742 178 A1 | 11/1996 | European Pat. Off. . |

OTHER PUBLICATIONS

Union Carbide Corporation; *Triton SP Surfactants —Triton® SP–Series Surfactants*; pp. 1–15; 1996. (no month available).

*Primary Examiner*—Caroline D. Liott
*Attorney, Agent, or Firm*—Adams, Schwartz & Evans, P.A.

[57] ABSTRACT

A method of applying a surface coating to an intermediate textile product to enhance the performance of the textile product in a downstream manufacturing process. The method includes the steps of preparing an application composition having a process-enhancing material, an acid-decomposable emulsifier and an acid; emulsifying the application composition in a water bath to improve the surface activity of the process-enhancing material; exposing the intermediate textile product to the water bath containing the application composition; and decomposing the emulsifier into non-surface active substances simultaneously with the step of applying the application composition to the intermediate textile product to thereby permit the process-enhancing material to exhaust onto the textile product.

11 Claims, No Drawings

METHOD OF PROCESSING TEXTILE PRODUCTS UTILIZING DECOMPOSABLE EMULSIFIERS

TECHNICAL FIELD AND BACKGROUND OF THE INVENTION

This invention relates to a method which utilizes a novel class of textile products which can be prepared from various base oils, such as mineral oil, synthetic oils, including poly-alpha-olefins and esters, silicone fluids, waxes and the like. Special decomposable emulsifiers are used in place of conventional emulsifiers. This application discloses a method for processing textile products wherein decomposable emulsifiers are used in lubricating or softening compounds to lubricate or soften textile materials by the exhaustion process wherein the emulsifiers gradually decompose into non-surface active components. The lubricant or softener applied to the yarn facilitates subsequent unwinding, and knitting or weaving operations.

As used herein, the terms "decomposable", "degradable" and "splittable" are intended to be interchangeable and generally refer to the process by which the hydrophobic and hydrophilic segments of the emulsifiers are "delinked" by hydrolysis or other chemical reaction into two non-emulsifying components. Reactions of this type are described in European Patent Nos. 742177 and 742178.

These unique lubricant and softener products may be either oil-based, i.e., with the special decomposable emulsifiers dissolved in the oil with no significant water in the products but dilutable in water to form an emulsion, or water-based emulsions with the oil-phase emulsified in water.

Lubricant and softener compounds are typically applied by the exhaust application method onto yarn, fabric, or garments by diluting the compound in a water-based bath along with the textile substrate and heating the bath to an appropriate temperature at an appropriate pH. They can also be applied by direct application, e.g., by use of a kiss roll, during coning or texturing, or onto sewing thread.

Essentially all current technology textile lubricants and softeners, especially coning and texturing oils used as lubricants, are made using conventional nonionic emulsifiers, such as nonylphenol ethoxylates and alkyl-alcohol ethoxylates. These conventional nonionic emulsifiers can contribute to dye-bleeding. In other words, residual emulsifiers contained in the lubricant applied to the dyed yarn can solubilize the dyes with which they come into contact and cause them stain adjacent, differently-colored yarns or fabric. In addition, when conventional lubricants are exhaust applied, the rate of exhaustion (or "strike rate") can only be controlled by the temperature and rate of temperature rise of the application bath.

As the application bath temperature is increased, conventional nonionic emulsifiers become less soluble as they reach their "cloud-point" temperature. This results in the oil emulsion "breaking" and the oil depositing on the textile substrate, as desired. If the exhaustion is not controlled properly, uneven amounts of lubricant are distributed throughout the yarn package from too fast a strike rate, or not enough lubricant is applied because of insufficient exhaustion.

When, as described herein, decomposable emulsifiers are used to make such lubricants or softeners, at least two significant technical advantages result:

First, When the emulsifiers are decomposed—for example during exhaust application—the decomposition products are no longer surface active, and are no longer capable of solubilizing dyes to cause bleeding or staining. In one preferred embodiment as disclosed herein, such a lubricating compound gradually decomposes when the lubricant application bath is below pH 5. Thus by using an acidic application bath, these emulsifiers gradually decompose into non-surface active species, and the oil phase gradually, yet completely, exhausts onto the textile substrate. For additional control of the exhaustion rate, an acid donor can be used in the application bath. These acid donor additives are typically hydrolyzable compounds that also gradually decompose in the hot water application baths to produce acidic residues to gradually drop the pH during the process cycle.

Second, such acid-degradable emulsifiers add an entirely new controlling mechanism to the exhaustion process. In accordance with the invention disclosed herein, both pH and temperature can be used to optimize exhaustion of the lubricant or softener onto the textile product.

Exhaust application of such textile lubricants is particularly important for "direct ship" yarns. In direct ship applications, the lubricant is applied during a package dyeing operation, and is, in fact, an integral part of the dyeing process. After completion of the dyeing operation, while the yarn packages are still in the package dyeing machine, the lubricant product is added to the final dye-bath rinse water and then exhaust applied by appropriate heating. When this lubricant application process is finished, the lubricated yarn packages are removed from the dye machine while still mounted on their plastic spools, dried, and shipped to customers for knitting or weaving. The direct ship process eliminates the steps of unwinding the dyed yarn packages, applying a lubricant, such as by kiss roll, and then rewinding onto cones for shipment to knitters and weavers.

The textile lubricants and softeners of this invention utilizing decomposable/degradable emulsifiers are particularly useful for exhaust applications because the exhaustion rate can be better controlled by adjusting both heat and pH for more level and complete application.

At the end of the process, no emulsifiers are left behind in the oil to cause dye-bleeding or "fogging." Fogging refers to the translucent film that forms on the inside of an automobile's windshield from volatile components in the car's interior, such as from dash boards, seat upholstery, headliner fabric, etc. Yarns and fabrics destined for automobile interiors are required to be "non-fogging." In other words, the fabric must not give off volatile substances which condense on the inside surfaces of the glass windshield and windows. Thus, the product and invention according to this application present several significant advantages over prior art lubricants and softeners.

SUMMARY OF THE INVENTION

Therefore, it is an object of the invention to provide a method of applying a surface coating to an intermediate textile product to enhance the performance of the textile product in a downstream manufacturing process.

It is another object of the invention to provide a method of applying a surface lubricant to an intermediate textile product to enhance the performance of the textile product in a downstream manufacturing process.

It is another object of the invention to provide a method of applying a surface softener to an intermediate textile product to enhance the performance of the textile product in a downstream manufacturing process.

It is another object of the invention to provide a method of applying a surface lubricant or softener to an intermediate textile product by decomposing an emulsifier in which the lubricant is emulsified to cause the lubricant to exhaust onto the textile product.

It is another object of the invention to provide a method of applying a surface lubricant or softener to an intermediate textile product in an exhaust process whereby residual amounts of emulsifier which could solubilize dye on the textile product and cause dye bleeding or fogging is prevented.

These and other objects of the present invention are achieved in the preferred embodiments disclosed below by providing a method of applying a surface coating to an intermediate textile product to enhance the performance of the textile product in a downstream manufacturing process. The method comprises the steps of preparing an application composition including a process-enhancing material, an acid-decomposable emulsifier and an acid; emulsifying the application composition in a water bath to improve the surface activity of the process-enhancing material; exposing the intermediate textile product to the water bath containing the application composition; and decomposing the emulsifier into non-surface active substances simultaneously with the step of applying the application composition to the intermediate textile product to thereby permit the process-enhancing material to exhaust onto the textile product.

According to one preferred embodiment of the invention, the process-enhancing material comprises an oil-based textile lubricant.

According to another preferred embodiment of the invention, the process-enhancing material comprises an oil-based textile lubricant selected from the group consisting of mineral oil, synthetic oil, silicone fluid and wax.

According to yet another preferred embodiment of the invention, the intermediate textile product comprises textile yarn on a yarn dyeing package.

According to yet another preferred embodiment of the invention, the method includes the step of dyeing the yarn in a dye vessel before exposing the oil-based textile lubricant to the yarn.

According to yet another preferred embodiment of the invention, the method includes the step of heating the water bath to a predetermined temperature at a predetermined rate for optimizing exhaustion and leveling of the oil-based textile lubricant.

Preferably, the process-enhancing material is a textile softener.

According to yet another preferred embodiment of the invention, the process-enhancing material is a textile softener selected from the group consisting of fatty amide-based softeners, polyethylene-based softeners, paraffin wax, fatty quaternary compounds and silicones.

According to yet another preferred embodiment of the invention, the intermediate textile product comprises textile yarn on a yarn dye package.

According to yet another preferred embodiment of the invention, the method includes the step of dyeing the yarn in a dye vessel before exposing the softener to the yarn.

According to yet another preferred embodiment of the invention, the method includes the step of heating the water bath to a predetermined temperature at a predetermined rate for optimizing exhaustion and leveling of the softener.

DESCRIPTION OF THE PREFERRED EMBODIMENT AND BEST MODE

The invention is further described below and in the accompanying tables.

The method according to this application utilizes emulsifiers exemplified by Triton® SP emulsifiers from Union Carbide. These emulsifiers were designed for applications such as metalworking fluids, metal cleaning formulations, industrial laundry applications, textile processing, etc., where the waste emulsified oil is collected and then the oil emulsion is subsequently treated with acid to decompose the Triton®SP emulsifiers into non-surface active components such that the emulsion splits into separate water and oil layers. The oil layer can then be skimmed off for proper disposal or recycling. The oil does not go "down the drain" as an emulsion in the waste water.

The Triton®SP emulsifiers are designed to be "splittable." The hydrophobic segment (e.g., a long-chain alkyl group) and the hydrophilic segment (a polyethylene glycol) are linked by acetal or ketal structures. This linkage is readily hydrolyzed under acidic conditions to break the molecule into two non-emulsifying components.

The method according to this applications uses these Triton® SP emulsifiers in a novel manner. The objective is not to collect residual oil for disposal or recycling, but rather to use the splitting properties of these emulsifiers to deposit virtually all of the oily components of the composition on the textile product during exhaust applications.

In addition to lubricants for textiles, this technology can also be used to prepare exhaustible textile softeners (such as those based on: fatty amides polyethylenes, paraffin waxes, fatty quaternary compounds, silicones, etc.). The gradual decomposition of the emulsifiers can better control the exhaustion of the softener emulsions for more level and complete application, and reduce the possibility of dye-bleeding and fogging.

Preferred embodiments of the application composition are set out below.

Table 1 provides a general description of an emulsified oil suitable as a textile yarn softener/lubricant.

TABLE 1

| CHARACTERISTICS | DESCRIPTION |
|---|---|
| Chemical Composition | Mineral Oil and Acid Decomposable Emulsifier |
| Appearance | Clear Liquid |
| Color, APHA | <50 |
| pH (5% in water) | 6.5 |
| Visc., SUS (100° F. | 111.6 |
| Visc., Kinematic, cS (40° F.) | 21.3 |
| Visc., Brookfield, cPs (72° F.) | 41.5 |
| Ionic Nature | Nonionic |
| Flash Point, ° F. (COC) | >400 |
| Boiling Point, ° F. | >400 |

Table 2 more specifically identifies the composition and manufacturing procedure of the composition set out in Table 1:

TABLE 2

To a clean simple mixing vessel, charge:

| PROCEDURE | PARTS BY WGT/1000 | GALLONS |
|---|---|---|
| EXK-516[1] | 923 | 128.6 |
| Triton ® SP-135[2] | 22.5 | 2.7 |
| Triton ® SP-160[3] | 27.5 | 3.2 |

TABLE 2-continued

| To a clean simple mixing vessel, charge: | | |
|---|---|---|
| PROCEDURE | PARTS BY WGT/1000 | GALLONS |
| Atmul[4] 695 | 25.0 | 3.1 |
| Water | 2.0 | 0.2 |

[1]A highly refined "white" mineral oil manufactured by Penreco. Viscosity is approx. 20 cSt at 40° C.
[2]Acid-decomposable emulsifier made by Union Carbide
[3]Acid-decomposable emulsifier made by Union Carbide
[4]glycerol mono-oleate manufactured by Witco, and used as a clarifying aid to assist emulsifiers in dissolving in base oil When the vessel is completely charged, the composition is mixed for at least 30 minutes. Light heat can be applied if necessary, but should not exceed 120° F., or emulsifiers may begin decomposing.

The composition identified in Tables 1 and 2 has application in softening and lubricating textile yarns in order to provide better downstream processing, such as winding, knitting or weaving. It is sold under the trademark Lubrol® VP 3453. Yarn processed with this composition has a soft, slick hand. The composition is used in a dye vessel after all dyeing and rinsing operations have been completed. Recommended concentration in water is 2.0–3.0% o.w.g. with 0.25% o.w.g. Acetic Acid. The temperature is raised to 120° F. for 20 minutes to allow for even application. The amount of acid, temperature and time may all be adjusted as necessary to optimize exhaustion and leveling. Proper procedure results in substantially complete exhaustion without any emulsifier residue.

Table 3 provides a general description of an emulsified oil suitable as a textile yarn lubricant:

TABLE 3

| CHARACTERISTICS | DESCRIPTION |
|---|---|
| Chemical Composition | Synthetic Oils and Acid Decomposable Emulsifiers |
| Appearance | Clear Liquid |
| Color, APHA | <50 |
| pH (5% in water) | 6.5 |
| Visc., SUS (100° F. | 268 |
| Visc., Kinematic, cS (40° F.) | 53 |
| Visc., Brookfield, cPs (72° F.) | 105 |
| Ionic Nature | Nonionic |
| Flash Point, ° F. (COC) | >400 |
| Boiling Point, ° F. | >400 |

Table 4 more specifically identifies the composition and manufacturing procedure of the composition set out in Table 3:

TABLE 4

| To a clean simple mixing vessel, charge: | | |
|---|---|---|
| PROCEDURE | PARTS BY WGT/1000 | GALLONS |
| Durasyn 168/SHF-82[5] | 882 | 127.3 |
| Triton ® SP-135[6] | 25.0 | 3.0 |
| Triton ® SP-160[7] | 30.0 | 3.5 |

TABLE 4-continued

| To a clean simple mixing vessel, charge: | | |
|---|---|---|
| PROCEDURE | PARTS BY WGT/1000 | GALLONS |
| Atmul[8] 695 | 62.5 | 7.8 |
| Water | 0.5 | 0.1 |

[5]A synthetic (poly-alpha-olefin) base oil. Viscosity approx. 50 cSt at 40° C. Durasyn 168 is made by Amoco. SHF-82 is made by Mobil Chemical.
[6]Acid decomposable emulsifier made by Union Carbide
[7]Acid-decomposable emulsifier made by Union Carbide
[8]glycerol mono-oleate manufactured by Witco, and used as a clarifying aid to assist emulsifiers in dissolving in base oil When the vessel is completely charged, the composition is mixed for at least 30 minutes and warmed during mixing to 100–120° F. Temperature should not exceed 120° F., or the emulsifier may begin to de-link.

The composition identified in Tables 3 and 4 has application in lubricating textile yarns in order to provide better downstream processing, such as winding, knitting or weaving. It is designed to be exhaust applied in textile yarn package dyeing machines. It is sold under the trademark Lubrol® VP 3461. Yarn processed with this composition has a soft, slick hand. The composition is used in a dye vessel after all dyeing and rinsing operations have been completed. Recommended concentration in water is 2.0–3.0% o.w.g. with 0.25% o.w.g. Acetic Acid. The temperature is raised to 120° F. for 20 minutes to allow for even application. The amount of acid, temperature and time may all be adjusted as necessary to optimize exhaustion and leveling. Proper procedure results in substantially complete exhaustion without any emulsifier residue.

A method of applying a surface coating to an intermediate textile product is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A method of applying a surface coating to an intermediate textile product to enhance the performance of the textile product in a downstream manufacturing process, comprising the steps of:

(a) preparing an application composition comprising a process-enhancing base oil material, an acid-decomposable emulsifier comprising a hydrophobic segment and a hydrophilic segment linked by acetal or ketal groups, and an acid;

(b) emulsifying the application composition in a water bath to improve the surface activity of the process-enhancing base oil material;

(c) exposing the intermediate textile product to the water bath containing the application composition; and (d) decomposing the emulsifier into non-surface active substances simultaneously with the step of applying the application composition to the intermediate textile product to thereby permit the process-enhancing base oil material to substantially completely exhaust into the textile product without leaving behind residual emulsifiers which adversely effect downstream textile processing and performance characteristics.

2. A method according to claim 1, wherein the process-enhancing base oil material comprises a textile lubricant.

3. a method according to claim 1, wherein the process-enhancing base oil material comprises a textile lubricant selected from the group consisting of mineral oil, synthetic oil, silicone fluid and wax.

4. A method according to claim 2, wherein the intermediate textile product comprises textile yarn on a yarn dyeing package.

5. A method according to claim 4, wherein method includes the step of dyeing the yarn in a dye vessel before exposing the oil-based textile lubricant to the yarn.

6. A method according to claim 1, 2, 3, 4 or 5, wherein the method includes the step of heating the water bath to a predetermined temperature at a predetermined rate for optimizing exhaustion and leveling of the oil-based textile lubricant.

7. A method according to claim 1, wherein said process-enhancing base oil material comprises a textile softener.

8. A method according to claim 7, wherein said process-enhancing base oil material comprises a textile softener selected from the group consisting of fatty amide-based softeners, polyethylene-based softeners, paraffin wax, fatty quaternary compounds and silicones.

9. A method according to claim 8, wherein the intermediate textile product comprises textile yarn on a yarn dye package.

10. A method according to claim 9, wherein the method includes the step of dyeing the yarn in a dye vessel before exposing the softener to the yarn.

11. A method according to claim 7, 8, 9 or 10, wherein the method includes the step of heating the water bath to a predetermined temperature at a predetermined rate for optimizing exhaustion and leveling of the softener.

* * * * *